US007810413B2

(12) United States Patent
Liu

(10) Patent No.: US 7,810,413 B2
(45) Date of Patent: Oct. 12, 2010

(54) HEXAGON SPANNER HANDLE FOR INCREASING TURNING FORCE

(76) Inventor: Yi-Feng Liu, No. 7, Lane 56, Zhongzheng Rd., Xinzhuang City, Taipei County (TW)

( * ) Notice: Subject to any disclaimer, the term of this patent is extended or adjusted under 35 U.S.C. 154(b) by 120 days.

(21) Appl. No.: 12/207,783

(22) Filed: Sep. 10, 2008

(65) Prior Publication Data

US 2010/0058898 A1 Mar. 11, 2010

(51) Int. Cl.
*B25B 23/16* (2006.01)

(52) U.S. Cl. ..... 81/177.4; 81/177.2; 81/439

(58) Field of Classification Search ..... 81/177.1, 81/177.2, 177.4, 177.6, 124.2, 125.1, 489, 81/490, 439

See application file for complete search history.

(56) References Cited

U.S. PATENT DOCUMENTS 2,569,069 A * 9/1951 Motel ..... 81/177.2
5,911,799 A * 6/1999 Johnson et al. ..... 81/177.4
6,209,425 B1 * 4/2001 Hu ..... 81/177.2
6,311,587 B1 * 11/2001 Johnson et al. ..... 81/177.4
6,332,381 B1 * 12/2001 Vasudeva ..... 81/177.2
6,490,954 B2 * 12/2002 Johnson et al. ..... 81/177.4
7,387,055 B2 * 6/2008 Liu ..... 81/440
7,441,481 B2 * 10/2008 Liu ..... 81/62
2009/0183608 A1 * 7/2009 Johnson et al. ..... 81/177.4

* cited by examiner

*Primary Examiner*—D. S Meislin
(74) *Attorney, Agent, or Firm*—Apex Juris, PLLC; Tracy M. Heims

(57) ABSTRACT

A hexagon spanner handle of the present invention includes a handle whose three edges are inwardly concaved respectively so as to form three shaft-like bodies at three triangle points. The handle has plural hexagonal apertures in different sizes arranged along the three shaft-like bodies. One plane surface of the handle has three position-limiting slots which are respectively located in three shaft-like bodies and outwardly extended along the shaft-like body and are communicating with the hexagonal apertures. The bottom of each position-limiting slot has plural indentations in different widths, and a magnetic body is located at the end of the position-limiting slot. Thereby, each hexagonal aperture can be inserted by the short leg of corresponding hexagon spanner, and the position-limiting slot can receive the long leg of the hexagon spanner with the magnetic body attracts thereof for fixing, so that the handle can be assembled with hexagon spanners in different standards.

5 Claims, 7 Drawing Sheets

HEXAGON SPANNER HANDLE FOR INCREASING TURNING FORCE

FIELD OF THE INVENTION

The present invention is related to a handle of hexagon spanner, and more particularly to an ergonomic handle which can position hexagon spanners in different standards for increasing the turning force.

BACKGROUND OF THE INVENTION

Generally, the hexagon spanner is formed to have an L shape and is used to insert into the hexagonal socket at the top of a screw for tightening or loosing thereof. The hexagon spanners are always sold in a set including various sizes for conforming to screws in different standards. Then, for providing holding convenience as turning, U.S. Pat. No. 5,592,859 disclosed "Tool handle for holding multiple tools of different sizes during use" as shown in FIG. 1 and FIG. 2, including a hexagonal wrench handle 1. The hexagonal wrench handle 1 has several apertures 2 formed therethrough with different external diameters in the radial direction, at least one holding slot 3 located on each of the six outer surfaces of the hexagonal wrench handle 1, wherein the holding slot 3 and the aperture 2 are perpendicular to each other so as to form an L shape, and each aperture 2 is inserted by the long leg 4*b* of an appropriately sized hexagon spanner 4 and the short leg 4*a* of the hexagon spanner 4 can be rested in the holding slot 3, and a sleeve 5 correspondingly sleeving on the hexagonal wrench handle 1 for covering the holding slot 3 so as to lock the short leg 4*a* of the hexagon spanner 4 therein or to reject the long leg 4*b* to position, thereby the long leg 4*b* of the hexagon spanner 4 can be used to insert into the hexagonal socket at the top of a screw and the hand also can hold the hexagonal wrench handle 1 for turning and tightening the screw.

However, the hexagonal wrench handle 1 is a hexagonal rod with six surfaces with the adjacent surfaces forming angles, so that when holding the handle to turn, the hand may feel uncomfortable. Besides, since the positions of the holding slots 3 for inserting different hexagon spanners are different, the positions for holding the hexagonal wrench handle 1 are also different, namely, the arm of force changes with different spanners, so that it is not easy to hold the hexagonal wrench handle 1 which does not conform to ergonomics.

SUMMARY OF THE INVENTION

The object of the present invention is to provide a hexagon spanner handle which can be inserted by hexagon spanners in different sizes for positioning thereof so as to rapidly assemble and position the hexagon spanners, and whose shape can conform to ergonomics so as to increase the turning force.

Another object of the present invention is to provide a handle with anti-slippery function so as to benefit the holding and turning.

For achieving the objects described above, the present invention provides a hexagon spanner handle including a handle having an approximately triangular shape whose three edges are inwardly concaved respectively so as to form three shaft-like bodies at three triangle points, and the three edges respectively have anti-slippery lines mounted thereon. The handle has plural hexagonal apertures in different sizes arranged along the three shaft-like bodies. One plane surface of the handle has three position-limiting slots which are respectively located in three shaft-like bodies and outwardly extended along the shaft-like body and are communicating with the hexagonal apertures. The bottom of each position-limiting slot has plural indentations in different widths, with the width of the indentations changes from large to small as the position thereof changes from center to rim so as to from a step-like shape, and a magnetic body is located at the end of the position-limiting slot. Thereby, the hexagonal aperture can be inserted by the short leg of a corresponding hexagon spanner, and the position-limiting slot can exactly receive the long leg of the hexagon spanner with the magnetic body attracts thereof for fixing, so that the long leg of the hexagon spanner can be inserted into a hexagonal socket at the top of a screw for turning tight or loose with the handle provides an ergonomic shape to help turning operation.

The present invention is advantageous that: the handle has plural hexagonal apertures for sleeving on the short legs of hexagonal spanners in different standards, the long leg of the hexagon spanner can be positioned in a corresponding indentation in the position-limiting slot so as to be limited by the walls in identical width, and the long leg of the hexagon spanner also can be attracted by the magnetic body for fixing, so that the end of the long leg can be inserted into a hexagonal socket at the top of a screw and the handle can be held by hand for turning tight or loose the screw, thereby achieving the purposes of rapid assembling and simple positioning.

Furthermore, the three edges of the handle according to the present invention are inwardly concaved for conforming to the holding ergonomics and increasing turning force, and the three edges also have anti-slippery lines respectively mounted thereon for providing anti-slippery function.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DESCRIPTION OF THE PREFERRED EMBODIMENT

Figure 1:
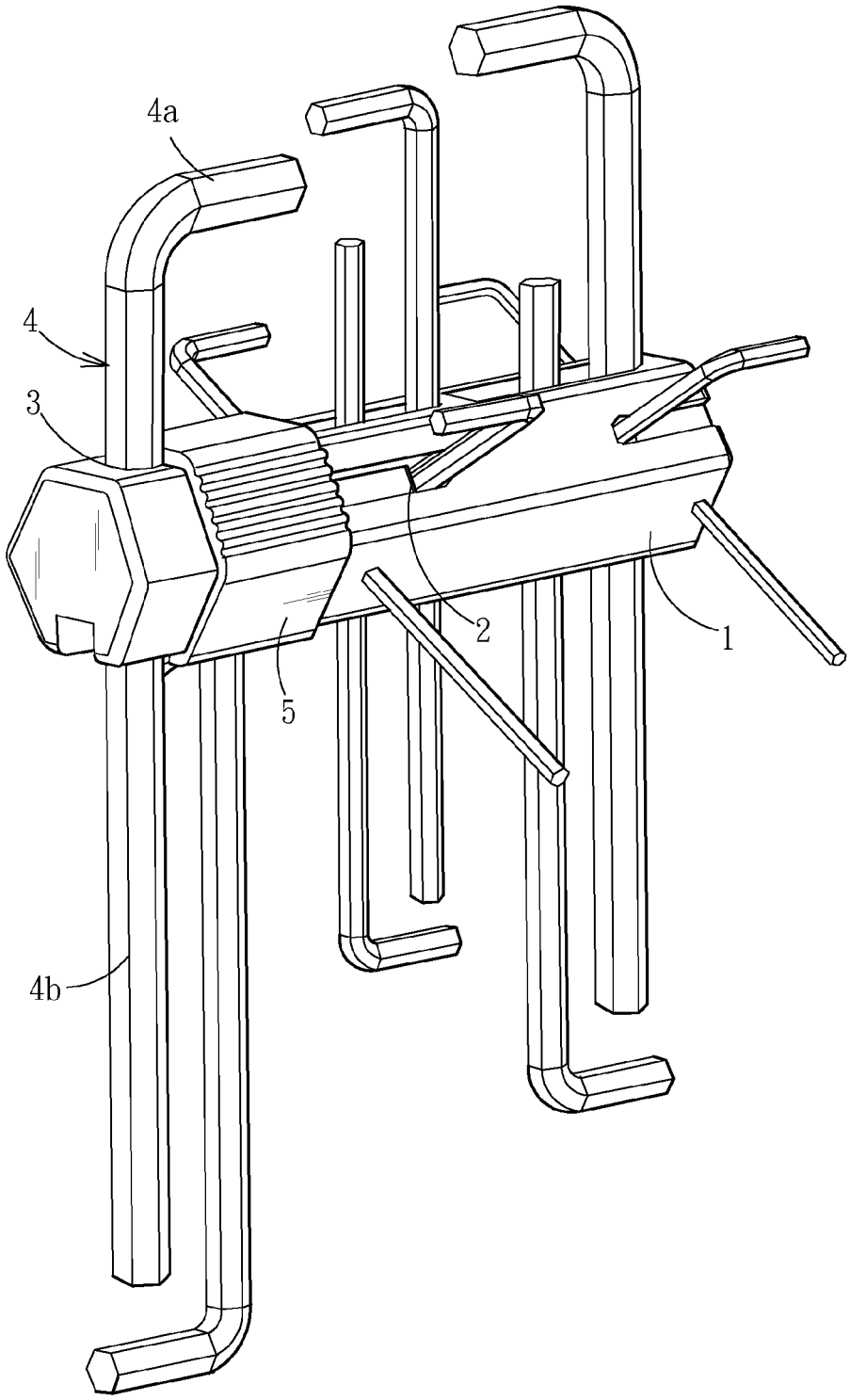
Fig. 1 PRIOR ART
FIG. 1 is a three-dimensional schematic view showing the hexagon spanner tool set of U.S. Pat. No. 5,592,859.
Figure 2:
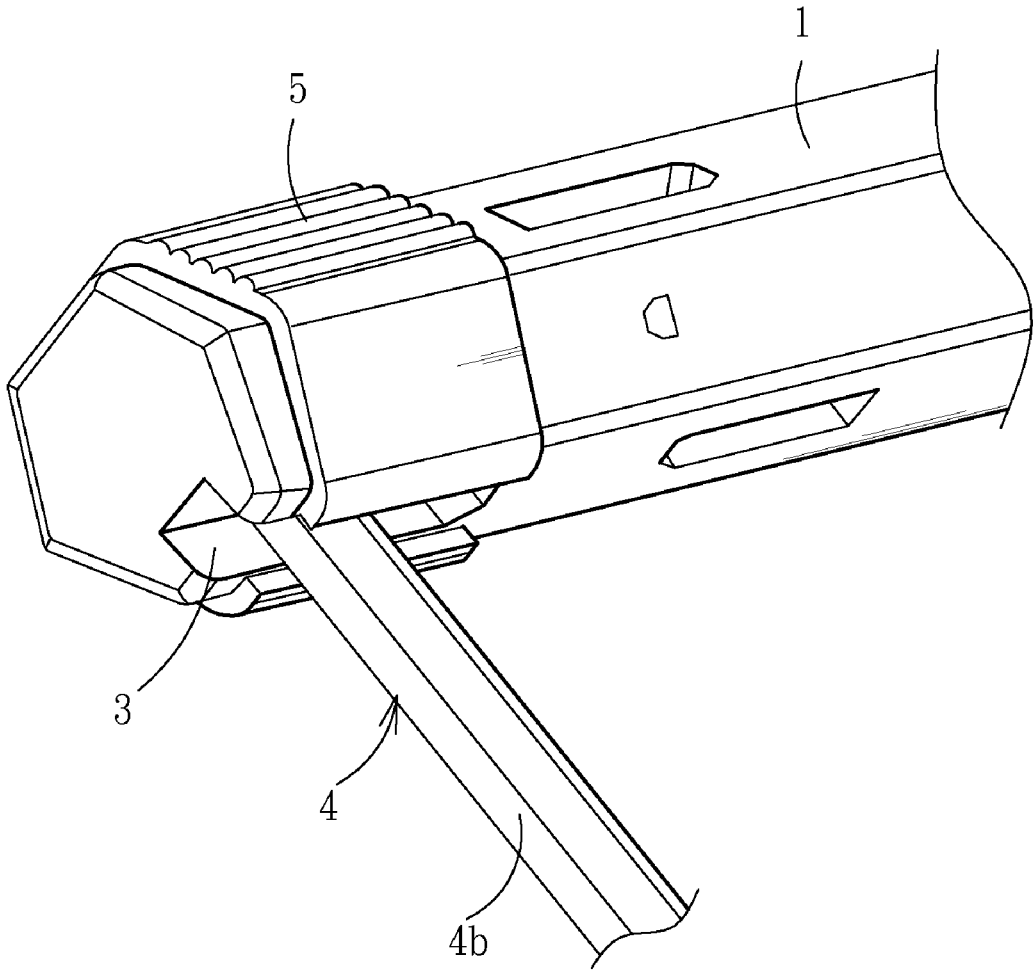
Fig. 2 PRIOR ART
FIG. 2 is a partial detailed drawing showing the hexagon spanner tool set of U.S. Pat. No. 5,592,859.
Figure 3:
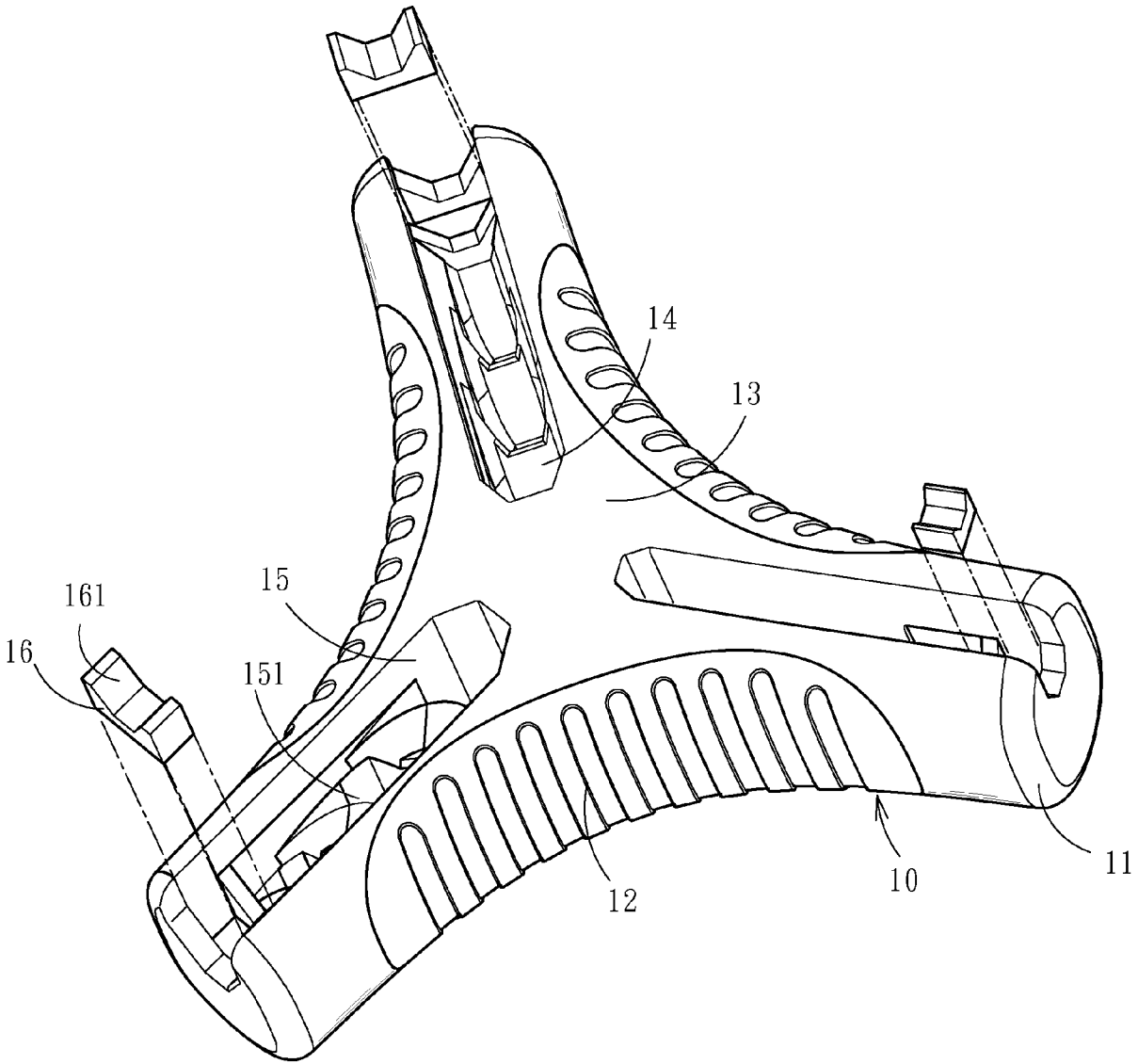
FIG. 3 is a three-dimensional schematic view showing a handle in a preferred embodiment of the present invention.
Figure 5:
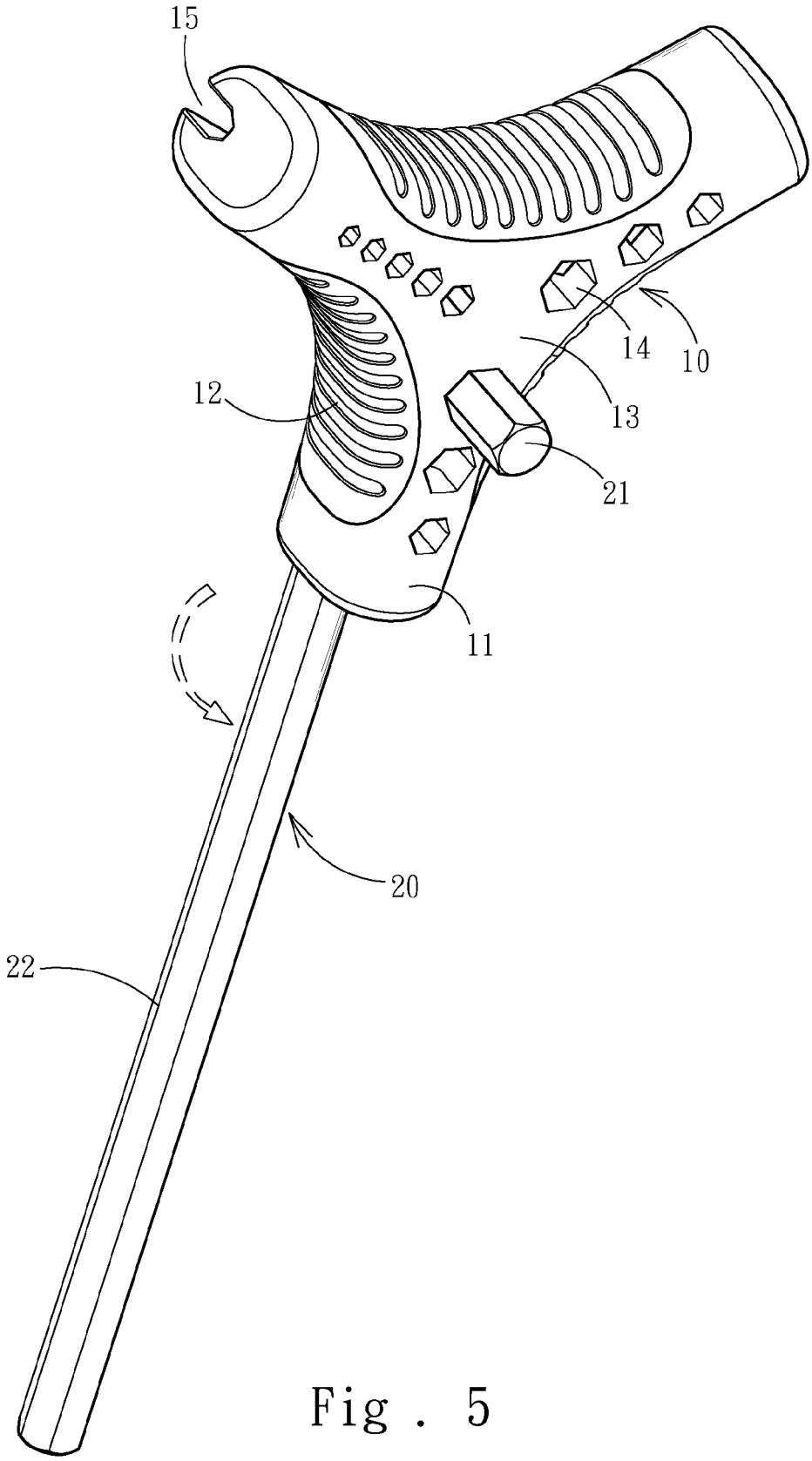
FIG. 5 is a three-dimensional schematic view showing the combination of handle and hexagon spanner from another direction.

Please refer to FIG. 3. A handle of hexagon spanner of the present invention capable of assembling with multiple hexagon spanners in different standards includes:

a handle 10, wherein the handle 10 is integrally formed by plastic material and has a shape approximately to a triangle, whose three edges are inwardly concaved respectively so as to form three shaft-like bodies 11 at three triangle points, the three edges of the handle 10 respectively have vertical grooves mounted thereon so as to form protruded anti-slippery lines 12 between adjacent grooves, and the handle 10 also has an upper and a lower horizontal plane surfaces 13, in which one of the plane surfaces 13 has plural hexagonal apertures 14 vertically formed therethrough, as shown in FIG. 5, the hexagonal apertures 14, three to five in a group, being arranged in three lines respectively along the three shaft-like bodies 11 with the size changes from large to small as the position changes from center to rim, and the other plane surface 13 of the handle 10 has three position-limiting slots 15 respectively located in three shaft-like bodies 11 and outwardly extended along the shaft-like body 11, the bottom of each position-limiting slot 15 having plural indentations 151, each of which is formed to have a wedge shape by three surfaces so as to correspond to the outer surface of the hexagon spanner. In each bottom of the position-limiting slot 15 with three to five indentations 151, the width of the indentations 151 changes from large to small as the position thereof changes from center to rim so as to from a step-like shape, and thus, the width and quantity of the indentations 151 can correspond to and communicate with the hexagonal apertures 14 opposite thereto. Furthermore, at the end of the position-limiting slot 15, a magnetic body 16 (such as magnet) with indentation 161 can be mounted, wherein the indentation 161 of the magnetic body 16 is formed to have a wedge shape by three surfaces and the indentation 161 of the magnetic body 16 has an upward opening.

Figure 4:
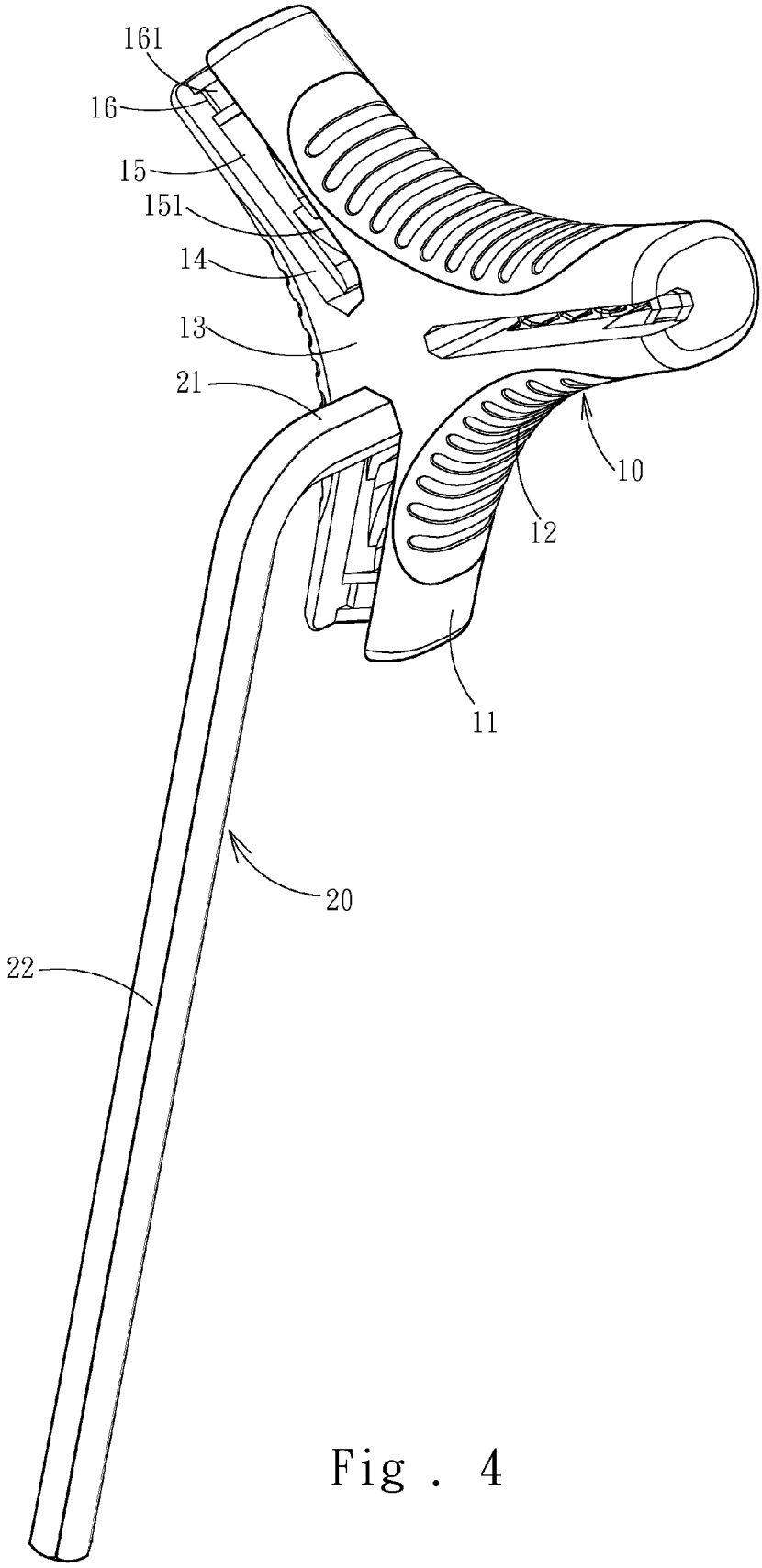
FIG. 4 is a three-dimensional schematic view showing the combination of handle and hexagon spanner in a preferred embodiment of the present invention.

The hexagon spanner 20, as shown in FIG. 4, is assembled with one of the hexagonal apertures 14 of the magnetic body 16 by having identical diameters, wherein the hexagon spanner 20 has an L shape with a short leg 21 and a long leg 22, and the section of the spanner is a hexagon.

Figure 6A:
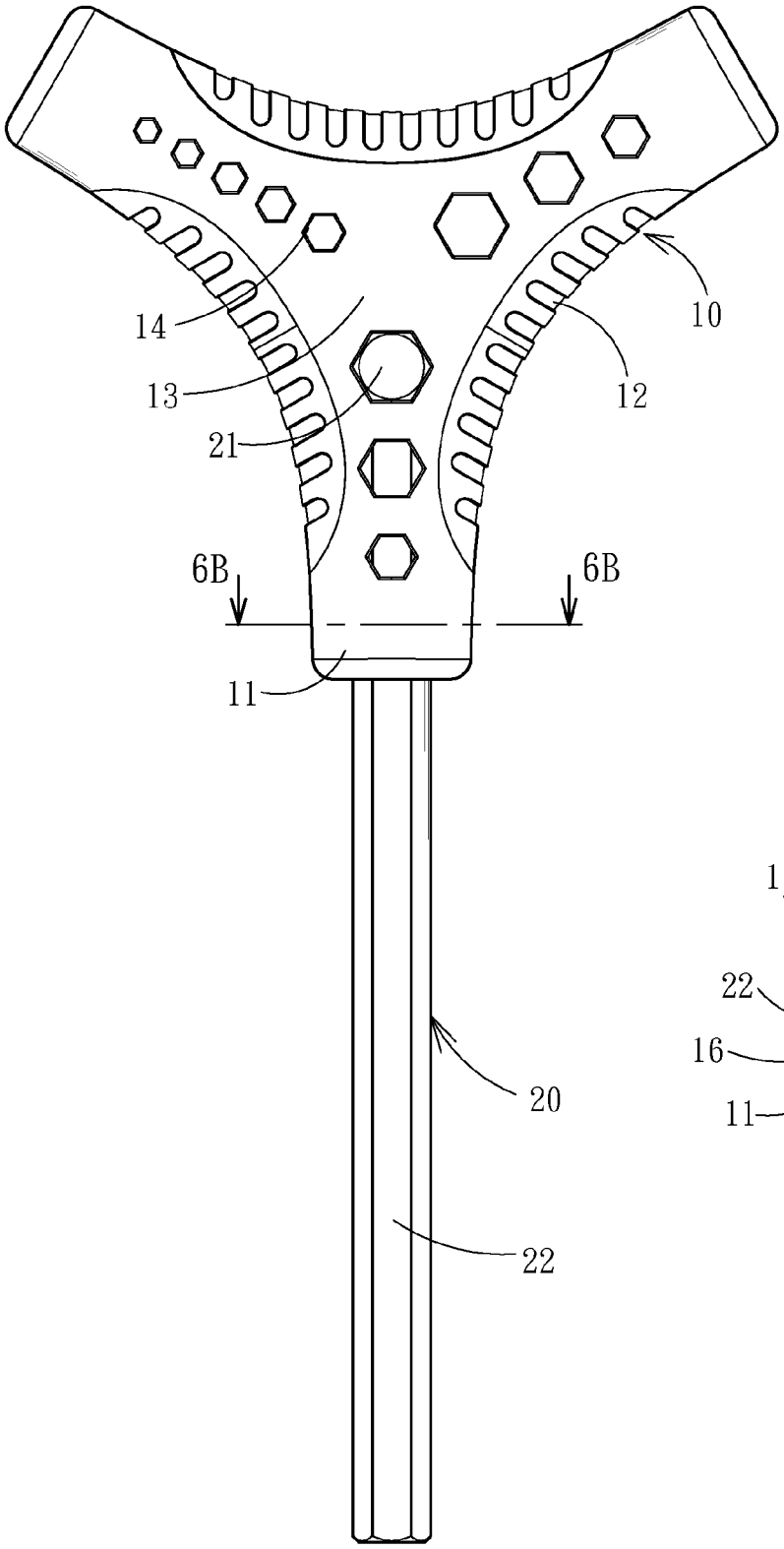
FIG. 6A is a plan view showing a preferred embodiment of the present invention.
Figure 6B:
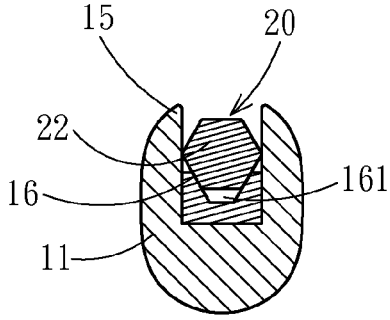
FIG. 6B is a sectional view of the 6B-6B line in FIG. 6A.
Figure 7A:
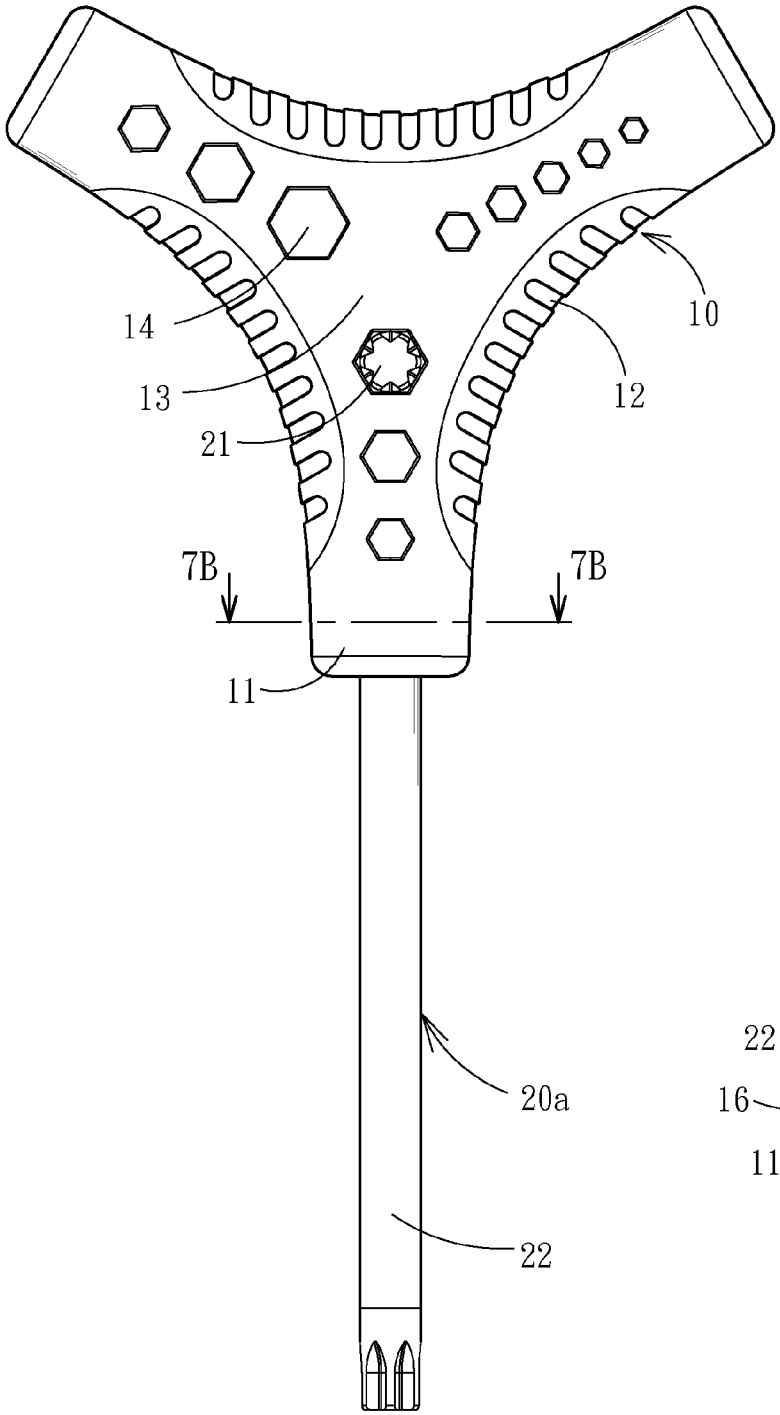
FIG. 7A is a plan view showing another preferred embodiment of the present invention.
Figure 7B:
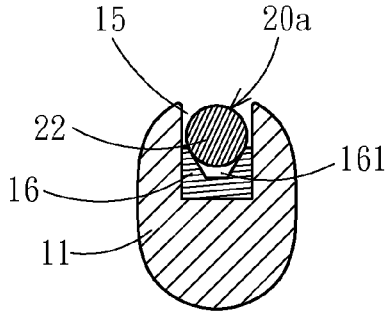
FIG. 7B is a sectional view of the 7B-7B line in FIG. 7A.

As operation, the user can pick a hexagon spanner 20 in accordance with his or her need and insert the short leg 21 of the hexagon spanner 20, from the plane surface having the position-limiting indentation 15 of the handle 10, into a corresponding hexagonal aperture 14, and the end of the short leg 21 will expose out of the hexagonal aperture 14 at the other plane surface 13 of the handle 10, as shown in FIG. 5 and FIG. 6A. Then, the long leg 22 of the hexagon spanner 20 can be exactly positioned in the position-limiting slot 15 and limited by the walls of the indentation 151, whose width is identical to the hexagon spanner 20. Furthermore, the hexagon spanner 20 also can be positioned in the indentation 161 of the magnetic body 16 for being fixed by the attraction of the magnetic body 16, as shown in FIG. 6B. Besides, the hexagon spanner 20 also can be hexagon spanner 20*a* which is formed by a column with a flower-shaped end, as shown in FIG. 7A and FIG. 7B, capable of inserting into the corresponding socket of a screw (not shown). Finally, the user can hold and turn the handle 10 for tightening or loosing the screw.

The present invention is advantageous that:

1. The handle 10 of the present invention has three to five hexagonal apertures 14 arranged along each shaft-like body 11 with each hexagonal aperture 14 can assemble with a corresponding hexagon spanner 20, 20*a*, wherein the long leg 22 of the hexagon spanner 20, 20*a* can be positioned in the position-limiting slot 15 and positioned by the corresponding indentation 151 and can be received and attracted by the indentation 161 of the magnetic body 16 for preventing from falling out, thereby it can be assembled and positioned easily.
2. The handle 10 of the present invention has anti-slippery lines 12 on three edges for avoiding from slipping, and further, the shape of the handle 10 conforms to holding ergonomics, so that the turning force can be increased.
3. The handle 10 of the present invention has multiple hexagonal apertures 14 in different sizes for sleeving on hexagon spanners 20, 20*a* in various standards of equal quantity, so as to tighten or loose multiple screws in different standards.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A hexagon spanner handle for assembling with multiple hexagon spanners in different standards, wherein each hexagon spanner has an L shape with a short leg and a long leg, comprising:

a handle having a shape approximately to a triangle, whose three edges are inwardly concaved respectively so as to form three shaft-like bodies at three triangle points, wherein one plane surface of the handle has plural hexagonal apertures vertically formed therethrough, in which the hexagonal apertures are arranged in three lines respectively along the three shaft-like bodies with the size changes from large to small as the position changes from a center of the shaft-like body to a rim of the shaft-like body, and the other plane surface of the handle has three position-limiting slots respectively located in said three shaft-like bodies and outwardly extended along the shaft-like body, in which the position-limiting slots communicate with the hexagonal apertures opposite thereto, and the bottom of each position-limiting slot has plural indentations in different widths, with the width and quantity of the indentations corresponding to the hexagonal apertures opposite thereto, and the width of the indentations changing from large to small as the position thereof changes from the center of the shaft-like body to the rim of the shaft-like body so as to form a step-like shape, thereby, the long leg is capable of locating in one of the position-limiting slots of the handle and matching with the corresponding indentation at the bottom of one of the position-limiting slots, and the short leg is capable of being inserted into the hexagonal aperture corresponding to the indentation.

2. The hexagon spanner handle as claimed in claim 1, wherein each indentation of each position-limiting slot is formed to have a wedge shape by three surfaces so as to match to the outer surface of the inserted hexagon spanner.

3. The hexagon spanner handle as claimed in claim 1, further comprising a magnetic body with indentation, wherein the magnetic body is located at the end of each position-limiting slot for attracting the long leg of the hexagon spanner.

4. The hexagon spanner handle as claimed in claim 3, wherein the indentation of the magnetic body is formed to have a wedge shape by three surfaces.

5. The hexagon spanner handle as claimed in claim 1, wherein the three edges of the handle respectively have vertical grooves mounted thereon so as to form protruded anti-slippery lines between adjacent grooves.

* * * * *